United States Patent [19]

Miller

[11] 4,156,498

[45] May 29, 1979

[54] CARRIER FOR FRAMED ART WORKS

[76] Inventor: Martin S. Miller, 3703 Green Spring Rd., Havre de Grace, Md. 21078

[21] Appl. No.: 884,748

[22] Filed: Mar. 9, 1978

[51] Int. Cl.[2] ..... B65D 71/04

[52] U.S. Cl. ..... 224/45 M; 206/451; 211/41; 224/52

[58] Field of Search ..... 224/29 R, 42.45 R, 45 R, 224/45 M, 45 P, 45 Q, 50, 51, 52, 54, 55, 56, 58, 42.1 D; 211/6, 7, 41; 214/10.5 R; 248/222.4, 223.1, 223.4, 224.1; 280/179 A; 206/1.7, 449, 451; 105/463, 464, 466, 467, 482

[56] References Cited

U.S. PATENT DOCUMENTS

| | | | |
|---|---|---|---|
| 409,379 | 8/1889 | Sutton | 224/52 |
| 1,055,098 | 3/1913 | Stone | 211/6 |
| 1,218,103 | 3/1917 | Moffat | 211/6 |
| 1,372,196 | 3/1921 | Roy | 211/6 |
| 2,831,808 | 4/1958 | Esseff et al. | 248/223.4 X |
| 3,709,358 | 1/1973 | Andrews et al. | 206/451 |
| 3,931,919 | 1/1976 | Gerber et al. | 224/29 R X |
| 4,055,284 | 10/1977 | Bott | 224/42.1 D |

FOREIGN PATENT DOCUMENTS

| | | | |
|---|---|---|---|
| 122637 | 8/1948 | Sweden | 224/45 M |
| 22870 of | 1892 | United Kingdom | 224/50 |
| 6709 of | 1910 | United Kingdom | 224/45 M |

*Primary Examiner*—Trygve M. Blix
*Assistant Examiner*—Winston H. Douglas
*Attorney, Agent, or Firm*—Samuel Lebowitz

[57] ABSTRACT

A knockdown carrier for a plurality of juxtaposed rectangular frames supporting canvas paintings and similar artwork, to bind and maintain them in spaced relation by means of pairs of rigid bars at longitudinally displaced points along said frames. Each pair of bars is provided with adjustably fixed spacer members which extend inwardly between the frames, with the respective members at the top and bottom being in alignment with each other to accommodate frames of different thicknesses. A flexible band encompasses the outer portions of the superposed rigid bars and the frames therebetween to bind and integrate the assembly for storage or transport, and in the latter case, a balanced handle device is detachably connected between the longitudinally displaced binding and spacing units. Stretcher rods between the bottom rigid bars and stabilizer buses connected between the top rigid bars may be used as accessory devices to insure the tightness of the individual and groups of frame assemblies.

11 Claims, 10 Drawing Figures

FIG. 1
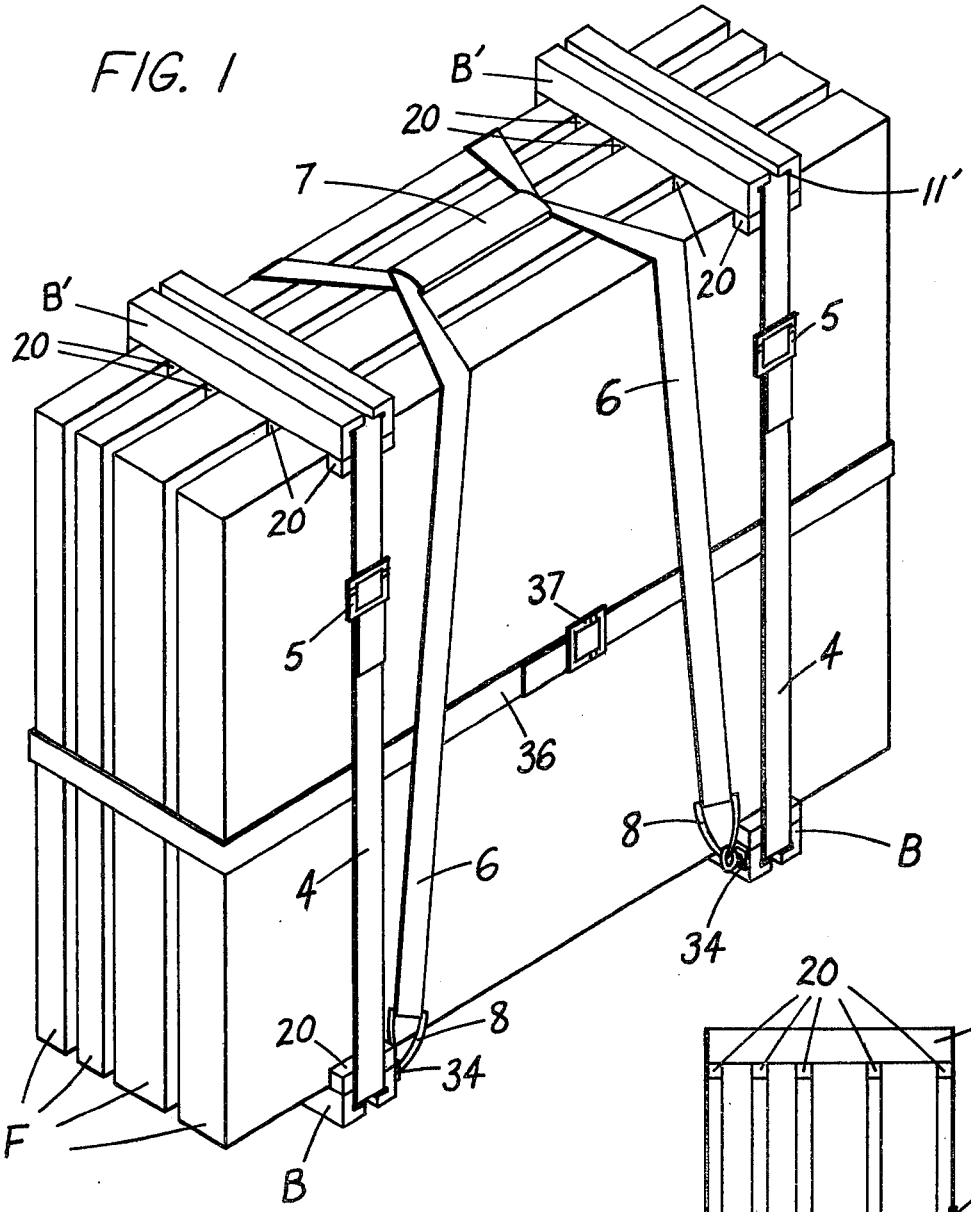
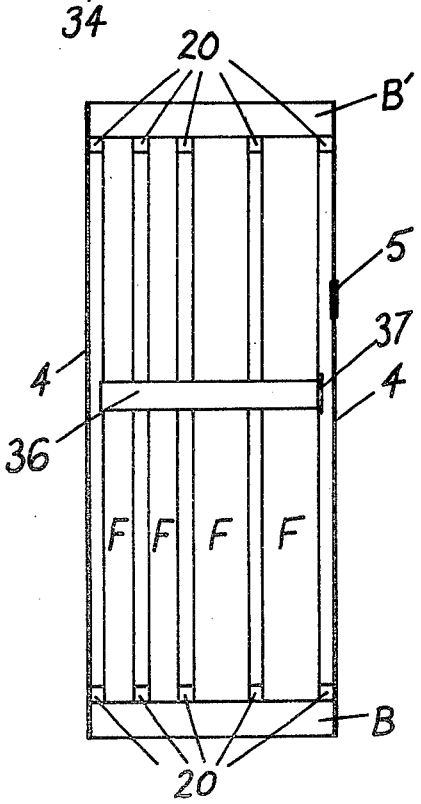
FIG. 2

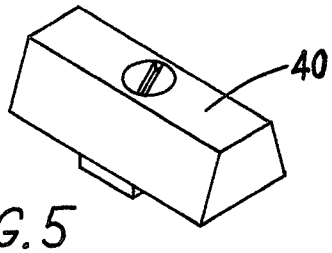
FIG. 5
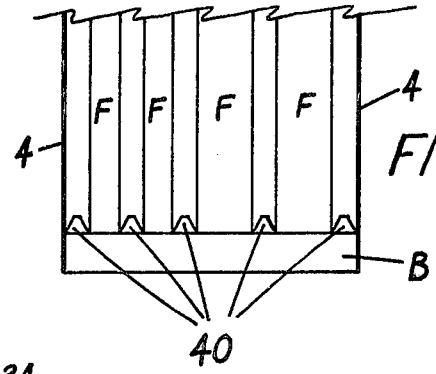
FIG. 6
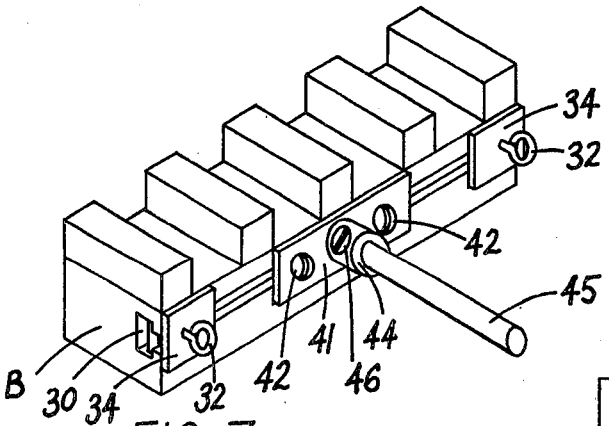
FIG. 7
FIG. 8
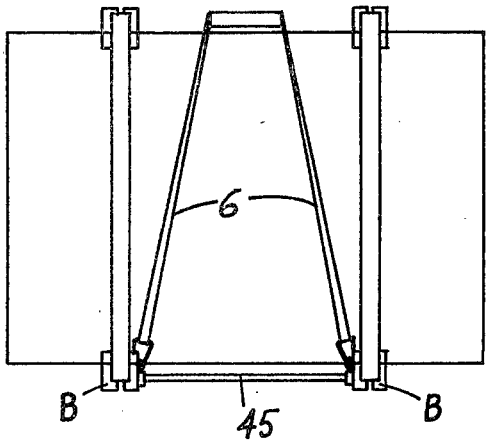
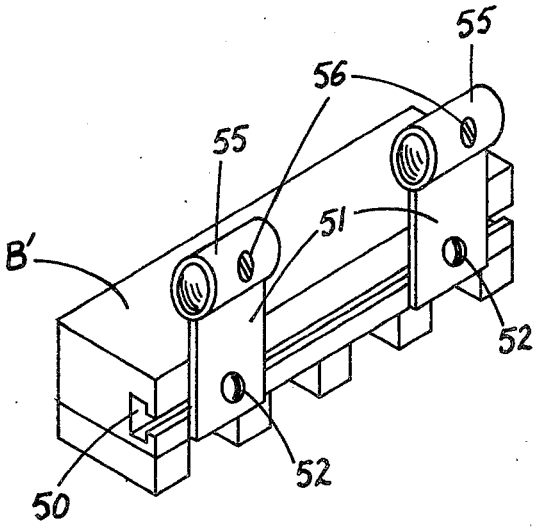
FIG. 9
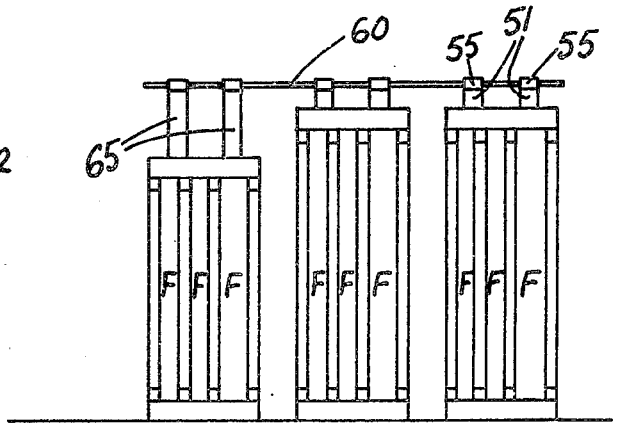
FIG. 10

CARRIER FOR FRAMED ART WORKS

This invention relates to a carrier for art work such as framed canvases, framed pictures and the like.

It is the object of the present invention to provide a commercially appealing and reliable carrier for a plurality of framed paintings or pictures which may be applied quickly and reliably for either storage or transportation.

The invention is particularly useful in the handling of paintings on canvas which are not completely dry, and which require a free space to permit the drying of the paintings without marring the surfaces thereof. It presents many advantages over previously known arrangements having similar objectives, as exemplified by U.S. Pat. No. 2,038,890, Apr. 28, 1936.

It is another object of the invention to provide a carrier for a plurality of frames which maintains the latter in spaced relation and which provides spacers or dividers for the frames which are easily adjusted to accommodate frames of different thicknesses.

The invention additionally incorporates handle means for connection with the elements of the carrier, which makes possible a convenient grasp of the complete assembly for easy transportation in a balanced condition.

The invention lends itself to economical manufacture by the use of extrusions of hard plastic material which may be cut to desired lengths to satisfy different marketing and utilitarian needs.

Other objects and purposes will appear from the detailed description of the invention following hereinafter, taken in conjunction with the accompanying drawings, wherein FIG. 1 is a perspective view of the carrier in assembled position encompassing four items of framed art work;

FIG. 2 is a left end view of FIG. 1;

FIG. 5 is a perspective view of a second embodiment of the spacer members which may be adjustably affixed to the rigid bars;

FIG. 6 is an end view similar to FIG. 2 with the spacer members according to the embodiment shown in FIG. 5;

FIG. 7 is a perspective view similar to FIG. 3, illustrating the inclusion of a mounting for a stretcher rod between the rigid bars at the bottom of the assembly;

FIG. 8 is a front elevation of the assembly which includes the stretcher rod shown in FIG. 7;

Figure 3:
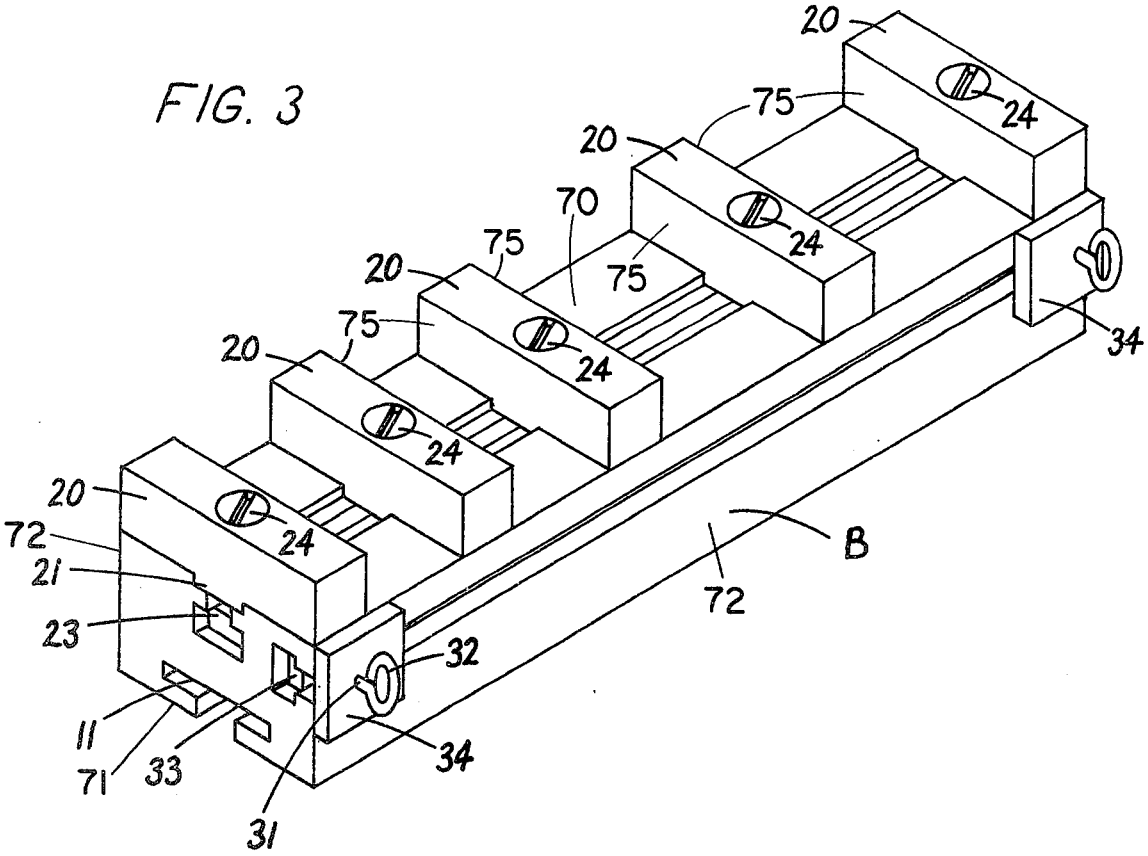
FIG. 3 is a perspective view of the rigid supporting bar at the bottom of the left end of FIG. 1.

FIG. 9 is a perspective view of mounting brackets of varying heights which may be affixed to the upper rigid bars of the frame assemblies and through which may be passed a rod to integrate a plurality of the assemblies to assure their maintenance in fixed position during transit; and FIG. 10 is an end view of a group of three frame assemblies with a unitary interconnecting bar extending between them.

In the drawings are shown the several elements of a knockdown assembly of rigid supporting bars for mounting a plurality of spacers at predetermined displacements, with confining straps in engagement with the rigid bars adapted to surround multiple frames of art objects for the purpose of binding the latter in spaced relation for convenient storage or transport.

The rectangular frame units F of art work, such as oiled canvases, water colors, lithographs, commercial prints, etc., are supported by a pair of rigid bars B at longitudinally displaced points at the bottom edges of the frames, and complementary rigid bars B′ resting upon the top edges of the frames in superposed alignment with the respective bars B. A flexible strap 4, of Nylon or similar material, engages each pair of the aligned rigid bars B,B′, and is tightened by a buckle 5 in order to maintain the frames in tightly assembled position.

Additional straps 6 extend from the opposite ends of the bottom supporting bars B and are interconnected at the top of the assembly by a handle 7, which affords a convenient means of grasping the package for transport.

Figure 4:
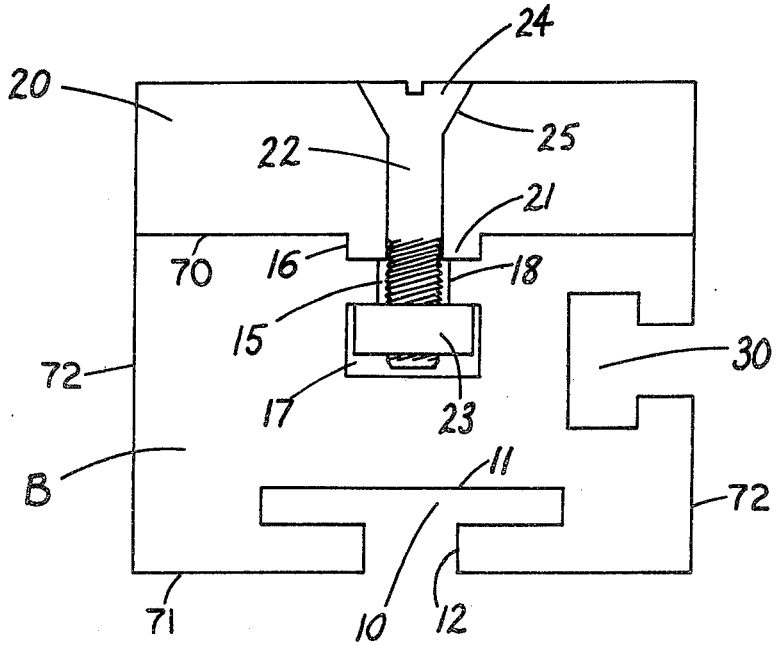
FIG. 4 is a left end view of the bar shown in FIG. 3.

The details of the assembly which render it commercially practical for the handling of all types of framed art works are more clearly illustrated in FIGS. 3 and 4.

The rigid bars B and B′ which extend across the bottom and top edges of the frames F (FIG. 1) have inner and outer surfaces 70 and 71, respectively, and opposed lateral surfaces 72.

The bars B,B′ may be produced of different materials, such as wood, or plastic. In the case of wood, the grooves and channels may be formed therein by routing, grooving and similar woodworking operations. However, extrusions of hard plastics such as rigid PVC or styrene are especially desirable because their strength properties are relatively isotropic and uniform, thus providing greater device dependability and easier quality control in manufacture.

As shown in FIGS. 3 and 4, the rigid bar B is preferably of rectangular section and is provided with a channel 10 of T-shaped cross-section centrally thereof for confining and guiding the strap 4 following its insertion into the channel of the bottom edge through the passage 12. A shallow dado groove may be used in lieu of a channel for guiding and retaining the strap or belt 4 in engagement with the bar B.

A channel 15 of I-shaped cross-section is cut in the upper portion of the bar B, in the edge opposite to that containing channel 10. Channel 15 has wide portions 16 and 17 at the top and bottom, respectively, with a narrowed portion 18 therebetween. A plurality of spacer members or dividers 20, each having a central protuberance 21 at the bottom thereof, are adapted to slide along the upper surface 14 of the block with the widened portion 16 of the channel 15 serving as a track for the lug or protuberance 21 extending into the channel. Each spacer member may be fixed in any desired position on the rigid bar by a bolt 22 extending through the mid-portion of the spacer and lug and the narrowed portion 18 of the channel 15 for engagement with a nut 23 confined within wide portion 17 of the channel, where it is restrained against rotary movement while capable of translating movement therealong. The head 24 of bolt 23 is flat and is designed to fit within the central countersunk opening 25 at the top of the divider member 20, to provide a smooth surface on the top of the divider.

The loosening of the bolts and nuts 22 and 23, by a slight rotation of the former, permits the free sliding movement of the spacers 20 along the block B to space them from each other any desired distance to accommodate frames of different thickness, and the tightening of the bolts clamps them in their adjusted positions.

Another T-shaped channel 30 may be provided in the lateral wall 72 of the bar B for receiving an eye-bolt 31 extending through plate 34 and terminating in the circular eye or ring 32 at one end and threadedly engaging a clamping nut 33 at the other end. The latter is restrained against rotary movement within the base of channel 30 similarly to nut 23 in passage 17 so that the eye-bolt 31,32 may be moved to any position along bar B and fixed thereat.

The bar B at the opposite end of the assembly shown in FIG. 1, is identical to that described above, but is disposed in allochiral relation, to accommodate the ends of the straps 6 which may be coupled to the rings 32 by snap-rings or triangular rings 8 at the ends of the straps.

The rigid bars B' at the top of the carrier are similar in construction to the bars B described above, but in this assembly the spacers extend downwardly between the frames, and the central protuberances or lugs 21 project upwardly into the tracks afforded by the widened channel along the bottom surface of the bar. Also, the bars B' are provided with guide surfaces 11' for guiding and confining the straps 4 in their retention along the lengths of the rigid bars and their traverse between the opposite ends thereof beyond the outermost frames F, to bind the latter tightly by means of the buckles 5. The channels 10' in the bars B', like the channels 10 in bars B, maintain the straps in place during the loosened condition of the parts of the assembly, preparatory to their tightening by buckles 5.

The bars B' are of simpler construction than the bars B by virtue of the elimination of the channel 30 in the lateral wall thereof. However, if the handle arrangement 7 is modified from that shown in FIG. 1, the top bars may be formed of plastic extrusions B similar to the ones at the bottom of the assembly.

If desired, a flexible girth band 36 may be strapped around the pack of frames F, as shown in FIG. 1, to attain an added factor of security. A toothed steel buckle 37, similar to the buckles 5 to tighten the straps 4, may be used to tighten the girth strap 36.

The inner surfaces 70 of the bars B and B', as shown in FIGS. 1 to 4, are in planes perpendicular to the lateral walls 75 of the spacer members so that the latter abut the front and rear faces of the frames. In some cases, it may be desirable that these lateral walls be spaced from the opposite faces of the frames, for example, in the case of incompletely dried paintings which are still wet at their top and bottom boundaries. FIG. 5 shows a spacer member 40 provided with lateral walls which are inclined relative to the opposite faces of the frames, and the free spaces afforded thereby adjacent to the frames are illustrated in FIG. 6. This is made possible by the inclination of the lateral walls of the spacer members from planes perpendicular to the inner surfaces of said bars.

The supporting straps 6 and connecting handle 7 may be modified in any desired respects to transform the pack from a resting storage position to one for convenient transport. It is noted that in the former case, the frames are above the floor level so that the incidence of any water on the floor, as in limited flooding conditions, cannot harm the framed art works.

The T-shaped channel 30 in the lateral wall 28 of the bars B, for receiving the plates 34, supporting the eye-bolts 31 which serve to carry the supporting rings 32 for the ends of the straps 6, may also be used for attaching other desirable accessories to the rigid bars. Thus, in FIGS. 7 and 8 are shown means for mounting one or more stretcher bars 45 between the bars B in order to maintain the spacing between the latter fixed.

As shown in FIG. 7, the plate 41 is provided with openings for receiving bolts 42 which engage "captive" nuts in the base of the channel 30 so that the plate 41 may be fixedly connected to the lateral edge of the rigid bar at any desired position thereof between the ends of the bar. The "captive" nuts may move along the channel, but cannot rotate therein so that the plate 41 may be loosened for movement or clamped at any desired point. A socket 44 protrudes from the external face of the plate 41 and is designed to receive one end of the stretcher bar 45, which may be clamped to the socket by means of set screw 46. As shown in FIG. 8, a similar plate is fixed to the companion bar B at the same intermediate position of the latter, so that the oppositely facing sockets 44 are in alignment for the reception of the stretcher bar. More than one set of plates 41 may be disposed between the end plates 34 for supporting a plurality of stretcher rods.

The bar 45 may be formed of telescopic parts to adjust the same to different lengths for the purpose of accommodating different spacings between the rigid bars B. Of course, the stretcher bar is rigidified by a set screw or any other form of clamping means, once the desired spacing is attained.

FIGS. 9 and 10 illustrate the adaptation of the T-shaped channels in the lateral walls of the top rigid bars B' for an entirely different purpose. Thus, as shown in FIG. 9, a mounting bracket 51 is provided with an opening at the lower end thereof for receiving a bolt 52 which is in engagement with a "captive" nut movable along the head of the T-shaped channel 50, and which may be clamped thereto at any desired point. The upper end of the bracket 51 is provided with means for connecting a stabilization bus or bar to the bracket which, in the illustrated embodiment, may be done by passing a cylindrical rod through the open cylindrical tube or sleeve 55 and fixing the same thereto by set screw 56. As shown in FIG. 9, two of such mounting brackets are provided for the passage of a common bar 60 therethrough.

In the case of transporting a plurality of frame assemblies of different sizes and heights, a common stabilization bar 60 may be provided which extends through aligned connectors 55 by arranging the latter at a common level, and this may be done by varying the heights of the bracket plates 51 extending from the T-shaped channels of the respective rigid bars B' which integrate the respective frame assemblies.

In FIG. 10 the bracket plates 51 in the two frame assemblies are of the same height, whereas the bracket assembly at the left is fitted with bracket plates 65 of greater lengths.

Of course, these bracket plates may be adjusted by providing cooperating telescoping plates which may be clamped in any desired position to bring the connector passages 55 into alignment, so that the unitary stabilization bar may be passed through all of the bracket sleeves, as shown in FIG. 10.

Having thus described the preferred embodiments of my invention, which are capable of modification, what I claim as new and desire to secure by Letters Patent, is to be measured by the scope of the following claims.

I claim:

1. A portable knockdown assembly for securing spacedly a plurality of art frames having straight parallel top and bottom edges, comprising (a) a rigid bar extending transversely across the top edges of the frames, and having outer and inner surfaces and opposed lateral surfaces with the inner surface adjacent to said frames, (b) spacer members adapted to be affixed to said inner surface of said bar at predetermined adjustable displacements from each other along the length of said bar and adapted to extend downwardly between top edges of the frames, (c) a second rigid bar extending transversely across the bottom edges of the frames below and in alignment with said first-mentioned bar, and having outer and inner surfaces and opposed lateral surfaces with the inner surface adjacent to said frames, (d) a second set of adjustable spacer members adapted to be affixed to the inner surface of said second bar along the length thereof and in alignment with the respective first-mentioned spacers and to extend upwardly between the bottom edges of the frames, (e) said spacer members adapted to be readily releaseable to permit the convenient adjustment of the spacings therebetween to conform to the thickness of the frames, (f) a flexible band adjacent to the outer surfaces of said bars and surrounding the frames, and (g) means for tightening said band into clamping relation around said bars and the frames confined between said spacer members.

2. A device as set forth in claim 1, wherein said rigid bars are provided with T-shaped channels extending along the outer surfaces thereof to permit the entry of said flexible band for engagement with the outer faces of said bars.

3. A device as set forth in claim 1, wherein (a) said rigid bars are provided with I-shaped channels along the inner surfaces of said bars, (b) a medial lug on each spacer member projecting into the outermost portions of said channels for sliding movement therein, (c) a threaded bolt extending through each spacer member at said medial lug, the intermediate portion of said I-shaped channels and into the innermost portions of said channels, and (d) a threaded nut in engagement with the free end of each bolt seated within said innermost portions and restrained against rotary movement, whereby said spacer members may be moved along said channels when the respective bolts and nuts are in loosened condition and clamped tightly to said rigid bars in any set position in response to the tightening of the respective bolts and nuts, to adjust the displacement of the spacer members along said rigid bars.

4. A device as set forth in claim 3, wherein each of said bolts is provided with a flat head having a kerf therein and seated within a countersunk hole at the outer surface of each spacer member.

5. A device as set forth in claim 4, wherein said rigid bars are provided with T-shaped channels extending along the outer surfaces thereof to permit the entry of said flexible band for engagement with the outer faces of said bars.

6. A device as set forth in claim 1, wherein one of said rigid bars is provided with a T-shaped channel extending along the lateral surface thereof adapted to detachably clamp therein an eye-bolt for receiving one end of a carrying strap.

7. An assembly as set forth in claim 6, including a duplicate set of said vertically aligned rigid bars and spacer members displaced longitudinally from the first set along the frames, supporting straps extending from the ends thereof connected to the eye-bolts fastened to the ends of the bottom rigid bars and terminating in a loop above said frames, and a carrying handle interconnecting the two loops of said supporting straps.

8. A device as set forth in claim 7, including a bracket adjustably mounted in the T-shaped channel of the bottom rigid bar of each set of bars with a socket facing each other, and a stretcher rod having the opposite ends thereof fixed in said sockets adapted to maintain the displacement between said bottom rigid bars.

9. An assembly as set forth in claim 1, including a duplicate set of said vertically aligned rigid bars and spacer members displaced longitudinally from the first set along the frames, supporting straps extending from a rigid bar of each set, and a carrying handle above the top of said frames connected to said supporting straps.

10. A device as set forth in claim 1 wherein said spacer members have lateral walls in planes extending perpendicularly to the plane of the inner surface of each bar to adapt said lateral walls for close abutment against the opposite faces of the frames confined thereby.

11. A device as set forth in claim 1, wherein said spacer members have lateral walls in planes inclined from perpendicular planes relative to the inner surface of each bar to provide a space between said walls and the opposite faces of said frames.

* * * * *